US010047956B2

(12) United States Patent
Strelec et al.

(10) Patent No.: US 10,047,956 B2
(45) Date of Patent: Aug. 14, 2018

(54) MONITORING EFFICIENCY AND OPERATIONAL MODE CHANGES OF COMBUSTION EQUIPMENT

(71) Applicant: Honeywell International Inc., Morristown, NJ (US)

(72) Inventors: Martin Strelec, Chodov (CZ); Jiri Vass, Prague (CZ); David Kucera, Bilovice nad Svitavou (CZ)

(73) Assignee: Honeywell International Inc., Morris Plains, NJ (US)

( * ) Notice: Subject to any disclaimer, the term of this patent is extended or adjusted under 35 U.S.C. 154(b) by 907 days.

(21) Appl. No.: 14/521,204

(22) Filed: Oct. 22, 2014

(65) Prior Publication Data

US 2016/0116374 A1 Apr. 28, 2016

(51) Int. Cl.
*F23N 1/02* (2006.01)
*F23N 1/00* (2006.01)

(52) U.S. Cl.
CPC ..... *F23N 1/022* (2013.01); *F23N 1/002* (2013.01); *F23N 2023/44* (2013.01); *F23N 2025/21* (2013.01); *F23N 2041/04* (2013.01)

(58) Field of Classification Search
CPC ..... F23N 1/022
See application file for complete search history.

(56) References Cited

U.S. PATENT DOCUMENTS 6,736,089 B1 * 5/2004 Lefebvre ..... F23J 3/023 122/379
7,720,641 B2 5/2010 Alagappan et al.
7,966,149 B2 6/2011 Samardzija et al.
8,046,191 B2 10/2011 Jammu et al.
2006/0074591 A1 * 4/2006 Jammu ..... G05B 23/0221 702/182
2009/0125155 A1 5/2009 Hill et al.
2009/0308331 A1 * 12/2009 D'Agostini ..... F23L 7/007 122/13.01
2013/0066615 A1 * 3/2013 Morgan ..... G05B 13/048 703/7

(Continued)

OTHER PUBLICATIONS

"Clustering-Based Performance Optimization of the Boiler—Turbine System". Kusiak, et al. IEEE Transactions on Energy Conversion. vol. 23, Issue 2, Jun. 2008. pp. 651-658.

(Continued)

*Primary Examiner* — Manuel L Barbee
*Assistant Examiner* — Raymond Nimox
(74) *Attorney, Agent, or Firm* — Brooks, Cameron & Huebsch, PLLC

(57) ABSTRACT

Methods, systems, and computer-readable media are described herein. One method embodiment includes determining an unscaled efficiency signal of combustion equipment using data measured from the combustion equipment, determining a theoretical efficiency signal of the combustion equipment using a theoretical efficiency surface of the combustion equipment and a subset of the measured data, and normalizing the unscaled efficiency signal using values from a correlated portion of the theoretical efficiency signal to monitor efficiency of the combustion equipment. Other embodiments can include providing a performance indicator of the combustion equipment in response to an operational mode change.

18 Claims, 8 Drawing Sheets

(56) References Cited

U.S. PATENT DOCUMENTS

| | | | | |
|---|---|---|---|---|
| 2013/0153062 | A1 | 6/2013 | Young et al. | |
| 2014/0260177 | A1 * | 9/2014 | Reed | F02C 9/22 60/39.24 |

OTHER PUBLICATIONS

"Constraint-Based Control of Boiler Efficiency: A Data-Mining Approach". Song, et al. IEEE Transactions on Industrial Informatics, vol. 3, No. 1, Feb. 2007. pp. 73-83.

"Combustion Efficiency Optimization and Virtual Testing: A Data-Mining Approach". Kusiak, et al. IEEE Transactions on Industrial Informatics. vol. 2, Issue 3, Aug. 2006. pp. 176-184.

"Meaningful energy efficiency performance metrics for the process industries". Kumana, et al. Proceedings of the Thirty-First Industrial Energy Technology Conference, New Orleans, LA, May 12-15, 2009. 10 pgs.

* cited by examiner

MONITORING EFFICIENCY AND OPERATIONAL MODE CHANGES OF COMBUSTION EQUIPMENT

TECHNICAL FIELD

The present disclosure relates to methods, systems, and computer-readable media for monitoring efficiency and operational mode changes of combustion equipment.

BACKGROUND

Combustion equipment, such as boilers and furnaces, can be used to transfer heat from one medium to another medium to generate power and/or heat. Efficiency of combustion equipment can include a relation of energy input to energy output. For example, efficiency of combustion equipment can be indicated by combustion efficiency, thermal efficiency, and/or fuel-to-fluid efficiency.

The efficiency (e.g., the efficiency of the combustion process) of the equipment can be reduced by faults and/or degradation in the equipment. Faults can include sudden events that rapidly decrease performance of combustion equipment. Degradations can include slow changes to the combustion equipment that cause degradation of performance of the equipment. For example, degradations can cause an increased input fuel at the same output performance (e.g., efficiency decrease).

Efficiency can be monitored to identify and/or prevent faults and/or degradation of combustion equipment. For instance, monitoring the efficiency can improve equipment performance, reduce levels of harmful emissions by the equipment, and/or extend the stability of the equipment, among other benefits. Further, the combustion equipment can be monitored to comply and/or assist in complying with environmental regulations and/or various regulatory codes.

Monitoring efficiency of combustion equipment, however, can be difficult due to incomplete measurements caused by various instrumentation set in applications of the combustion equipment. Further, a number of variables used to calculate an efficiency may be unknown, such as liquid mass flow. Further, the output of the efficiency may be calculated and/or represented in technical units that may be difficult for a user to understand.

DETAILED DESCRIPTION

Figure 1:
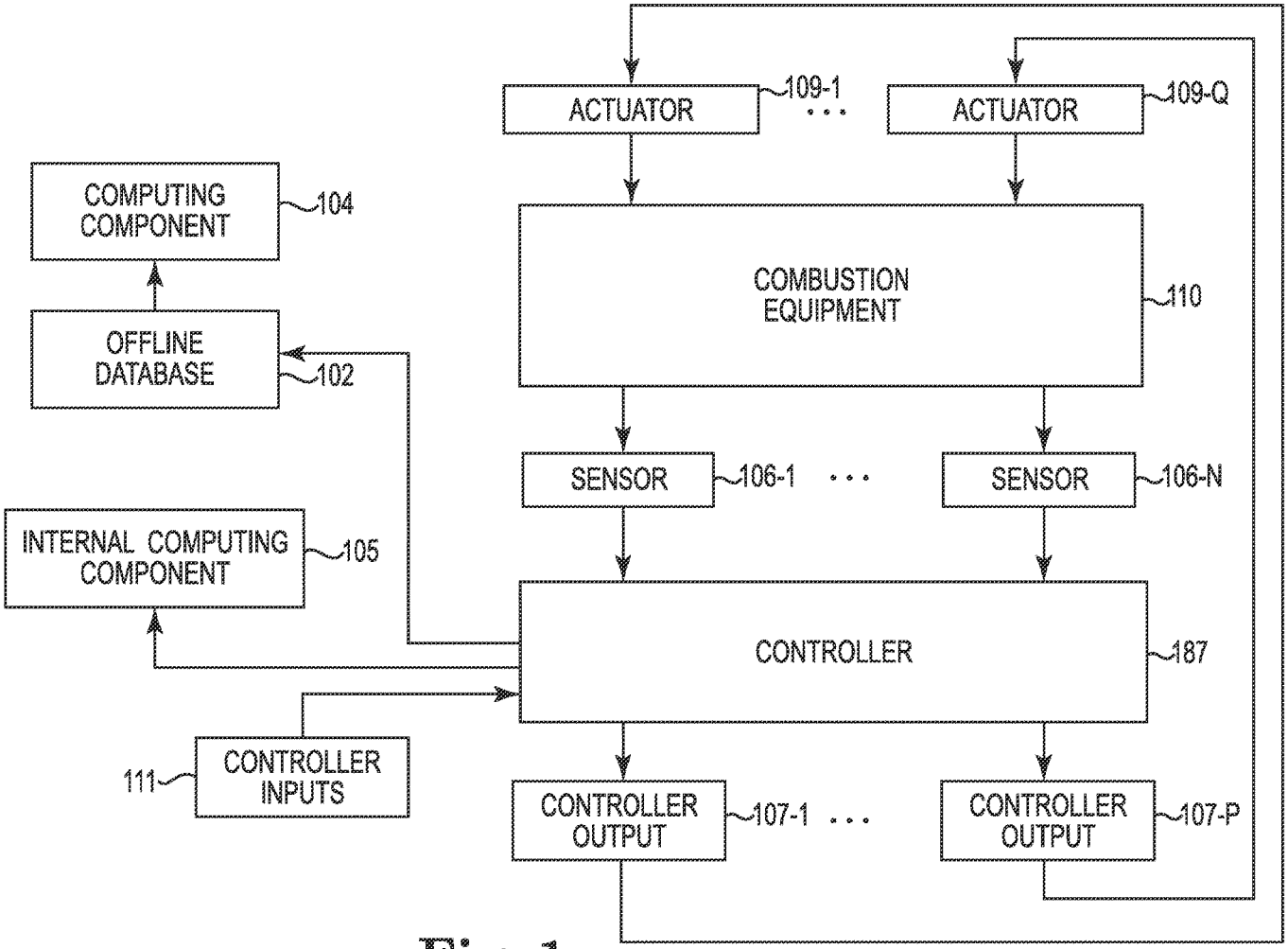
FIG. 1 illustrates an example of an efficiency monitoring system in accordance with one or more embodiments of the present disclosure.

Methods, systems, and computer-readable media for monitoring efficiency and operational mode changes of combustion equipment are described herein. For example, one or more method embodiments can include determining an unscaled efficiency signal of combustion equipment using data measured from the combustion equipment, determining a theoretical efficiency signal of the combustion equipment using a theoretical efficiency surface of the combustion equipment and a subset of the measured data, and normalizing the unscaled efficiency signal using values from a correlated portion of the theoretical efficiency signal to monitor efficiency of the combustion equipment.

Monitoring the efficiency of combustion equipment in accordance with the present disclosure can identify and/or prevent faults and/or degradation of the combustion equipment. As previously discussed, efficiency can be indicated by combustion efficiency, thermal efficiency, and/or fuel-to-fluid efficiency (also known as overall efficiency). Combustion efficiency can indicate an efficiency of the combustion process, which can include an ability of a burner to burn fuel measured by unburned fuel and excess air in the exhaust, combustion losses due to hydrogen in fuel, and/or other aspects influencing the efficiency of the fuel combustion.

Thermal efficiency can indicate the effectiveness of a heat exchanger to transfer heat from the combustion process to the liquid (e.g., water) or steam in the boiler, radiation and convention losses, and/or other aspects influencing the heat exchange between the combustion chamber of the combustion equipment and the target energy distribution medium (e.g., hot water distribution circuit). Fuel-to-fluid efficiency can indicate an overall efficiency of the boiler inclusive of the thermal efficiency and the combustion efficiency.

Prior approaches for determining efficiency of combustion equipment can include attaching special instrumentation to the combustion equipment that can collect data from the combustion equipment. However, measurements made by the special instrumentation can be incomplete. Further, a number of variables used to determine the efficiency may be unknown, and/or the resulting efficiency may be represented in difficult to understand technical units. Further, due to the cost of the special instrumentation, the determination may be made only once per a period of time (e.g., once or twice a year).

As such, the prior approaches may be ineffective at identifying and/or preventing degradations in combustion equipment. For example, prior approaches may take measurements only once or twice a year to determine efficiency, and the determination can include the use of unknown variables, which may not provide enough data points to identify and/or prevent a degradation and/or faults of the combustion equipment, for example.

In contrast, embodiments in accordance with the present disclosure can include methods, systems, and computer-readable and executable media for monitoring efficiency that uses existing sensors attached to the combustion equipment to monitor the efficiency of the combustion equipment. For example, the existing sensors can include temperature sensors used in the combustion equipment control (e.g., feedback control). The sensors can measure data from the combustion equipment periodically and/or continuously. The measured data can be used to determine an unscaled efficiency signal of the combustion system.

The unscaled efficiency signal can be compared to a theoretical efficiency signal and normalized based on the comparison to create a normalized efficiency that is in physical units. For instance, physical units can include a value (e.g., %, degrees, etc.) that can be used for relative and absolute assessment. Physical units may be defined using various systems of units, such as the International System of Units (SI) and/or the imperial system of units, etc. Technical units, by contrast, can include a value that can be used for relative assessment (but not absolute assessment) and can reflect the actual efficiency of the combustion equipment. The theoretical efficiency can be determined using offline data, such as manufacturer data for the combustion equipment (e.g., datasheets and commissioning data) or data measured from the combustion equipment from a previous period of time.

By using existing sensors and comparing an unscaled efficiency signal to a theoretical efficiency signal, embodiments in accordance with the present disclosure can be used to easily and/or cheaply identify and/or prevent degradations and/or faults. For instance, the existing sensors are relatively inexpensive, and the monitoring can be performed more often than compared to prior approaches.

Monitoring the combustion equipment more often can result in more data points and can assist in identifying and/or preventing degradations and/or faults, such as small changes in efficiency. Further, using offline data can increase accuracy and can result in an output value in physical units. An efficiency in physical units can be easier for a user to understand than technical units.

In addition, a number of embodiments can include providing a performance indicator that indicates an operational mode change in the combustion equipment. An operational mode change can include an increase in fuel consumption and can occur as a result of control strategy changes, faults, and/or changes to input variables, as discussed further herein. The performance indicator can be provided in response to a change in an identified parameter from measured data as compared to a baseline parameter. In some embodiments, the performance indicator can be provided in response to an expected fuel consumption meeting or exceeding a threshold change from measured fuel consumption.

These embodiments are described in sufficient detail to enable those of ordinary skill in the art to practice one or more embodiments of this disclosure. It is to be understood that other embodiments may be utilized and that process, electrical, and/or structural changes may be made without departing from the scope of the present disclosure.

As will be appreciated, elements shown in some embodiments herein can be added, exchanged, combined, and/or eliminated so as to provide a number of additional embodiments of the present disclosure. The proportion and the relative scale of the elements provided in the figures are intended to illustrate the embodiments of the present disclosure, and should not be taken in a limiting sense.

The figures herein follow a numbering convention in which the first digit or digits correspond to the drawing figure number and the remaining digits identify an element or component in the drawing. Similar elements or components between different figures may be identified by the use of similar digits. For example, 104 may reference element "04" in FIG. 1, and a similar element may be reference by 204 in FIG. 2.

As used herein, "a" or "a number of" refers to one or more. For example, "a number of sensors" can refer to one or more sensors. Additionally, the designator "N" as used herein, particularly with respect to reference numerals in the drawings, indicates that a number of the particular feature so designated can be included with embodiments of the present disclosure.

FIG. 1 illustrates an example of an efficiency monitoring system in accordance with one or more embodiments of the present disclosure. As shown in FIG. 1, the efficiency monitoring system can include combustion equipment 110, a computing component 104, a controller 187, a number of sensors 106-1, . . . , 106-N and/or an offline database 102.

Combustion equipment, as used herein, can include a number of devices and/or components that convert and/or assist in the conversion of heat from one medium to another. Example combustion equipment can include boilers and/or furnaces.

A sensor, as used herein, can include any suitable device that measures and/or takes a physical quantity. In some embodiments, the number of sensors 106-1 . . . 106-N can include existing sensors that are connected to the combustion equipment 110 (e.g., are connected with or without the efficiency monitoring system). For example, the number of sensors 106-1 . . . 106-N can exist for combustion equipment control. In some embodiments, the number of sensors 106-1 . . . 106-N can include a fuel consumption sensor, as discussed further herein.

The number of sensors 106-1 . . . 106-N can, for example, measure data (e.g., online data) from the combustion equipment 110. The data can include temperature of supply liquid, temperature of return liquid, firing rate of the combustion equipment, and, in some embodiments, fuel consumption. The measured data can include online data, in some embodiments. Online data, as used herein, can include data measured directly from the combustion equipment 110 and/or actual values of internal parameters (e.g., inputs to and outputs from a controller 187) not directly associated with a sensor measurement. The sensors 106-1 . . . 106-N can output measurements (e.g., sensor measurements) to a controller 187, as discussed further herein.

The number of sensors 106-1 . . . 106-N can send and/or allow a device to retrieve the measurements that are made for combustion equipment control (e.g., boiler control). The data can be measured periodically, such as once a day, every 15 minutes, every 5 seconds, etc.

Although not shown in FIG. 1 for clarity and so not to obscure embodiments of the present disclosure, the computing component 104 and/or the internal memory component 105 can include a memory and a processor coupled to the memory. The memory can be any type of storage medium that can be accessed by the processor to perform various examples of the present disclosure. For example, the memory can be a non-transitory computer readable medium having computer readable instructions (e.g., computer program instructions) stored thereon that are executable by the processor to perform various examples of the present disclosure.

The memory can be volatile or nonvolatile memory. The memory can also be removable (e.g., portable) memory, or non-removable (e.g., internal) memory. For example, the memory can be random access memory (RAM) (e.g., dynamic random access memory (DRAM) and/or phase change random access memory (PCRAM)), read-only memory (ROM) (e.g., electrically erasable programmable read-only memory (EEPROM) and/or compact-disc read-only memory (CD-ROM)), flash memory, a laser disc, a digital versatile disc (DVD) or other optical disk storage, and/or a magnetic medium such as magnetic cassettes, tapes, or disks, among other types of memory. Further, the memory can be located in the computing component, or internal to another computing component (e.g., enabling computer readable instructions to be downloaded over the Internet or another wired or wireless connection).

The computing component 104 can be in communication with the number of sensors 106-1 . . . 106-N, the combustion equipment 110, the controller 187, and/or the offline database 102 via a communication path. The communication path, in some embodiments, can include a wireless and/or wired communication between the computing component 104 and the sensors 106-1 . . . 106-N, the combustion equipment 110, the controller 187, and/or the offline database 102. For instance, the communication path can be such that the computing component 104 is remote from the sensors 106-1 . . . 106-N, the combustion equipment 110, the controller 187, and/or the offline database 102 such as in a network relationship between the computing component 104 and the sensors 106-1 . . . 106-N, the combustion equipment 110, the controller 187, and/or the offline database 102. That is, the communication path can be a network relationship. Examples of such a network relationship can include a local area network (LAN), wide area network (WAN), personal area network (PAN), and the Internet, among others.

The computing component 104 can, in some embodiments, be located remotely from the number of sensors 106-1 . . . 106-N. For instance, the number of sensors 106-1 . . . 106-N can communicate measured data to the computing component 104, the controller 187 and/or the offline database 102 using a network communication. As an example, the computing component 104 can be located with the offline database 102.

Figure 3:
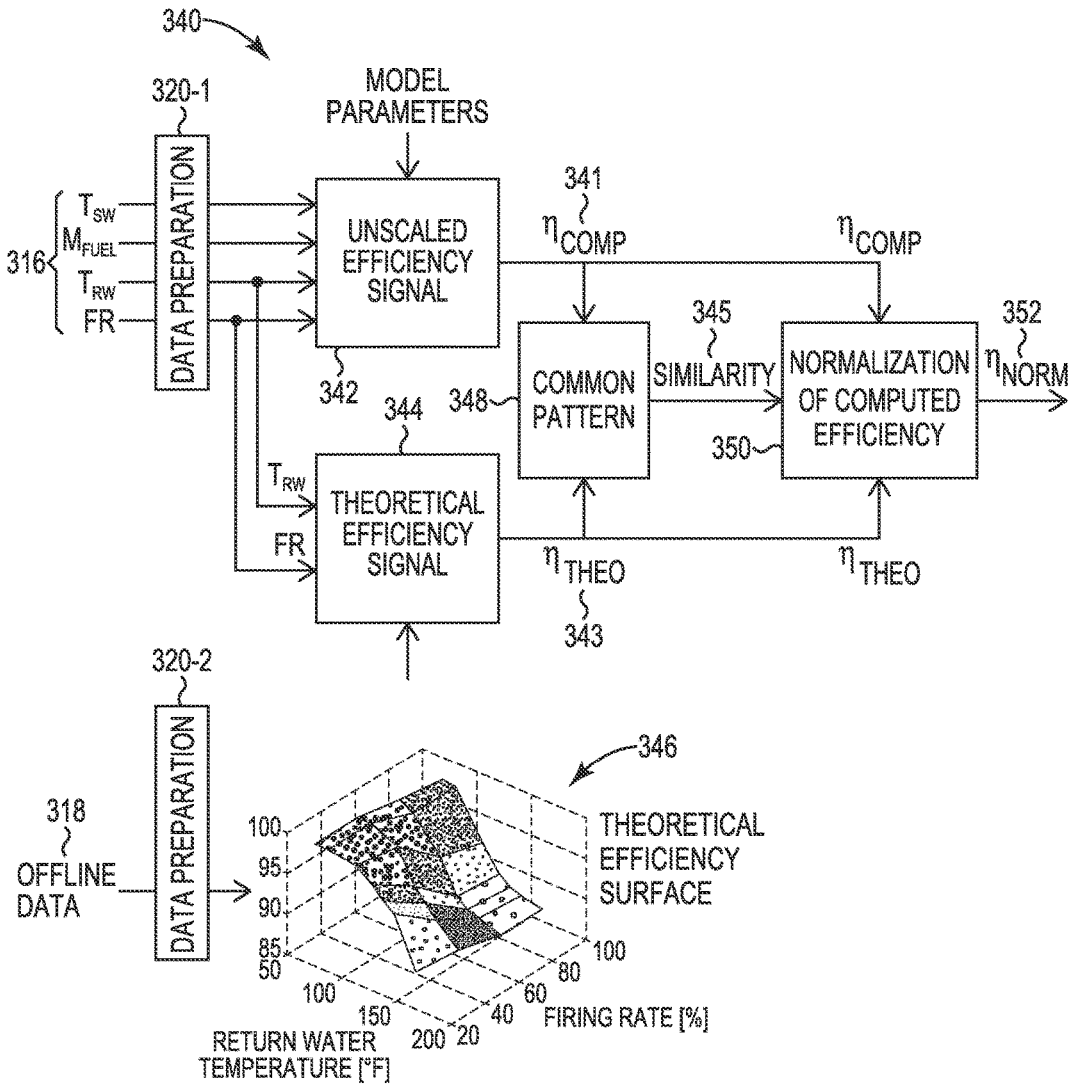
FIG. 3 illustrates an example of a process for monitoring efficiency of combustion equipment in accordance with one or more embodiments of the present disclosure.

The medium can include instructions executable by a processing resource to cause the computing component to perform a number of functions as discussed further in connection with FIG. 3. The functions can be performed as the data is received (e.g., a live stream and/or near live stream) and/or the data can be stored on the offline database 102 and the functions can be performed at particular periods of time (e.g., once a day, once an hour, etc.).

Alternatively and/or in addition, the computing component can be internal to a controller 187 of the combustion equipment and/or other combustion equipment, as illustrated by internal computing component 105. For example, the internal computing component 105 can be internal to a boiler in a number of embodiments.

A controller 187 can include a device (such as a microprocessor or computing device) that monitors and alters the operating conditions of the combustion equipment 110 (e.g., controls temperature, actuator positions, etc.). For example, the number of sensors 106-1 . . . 106-N can be connected to the controller 187 of the combustion equipment 110.

As illustrated by FIG. 1, the number of sensors 106-1 . . . 106-N can input sensor measurements to the controller 187 (e.g., the temperature of return liquid, temperature of supply liquid, etc.) and the controller 187 can output a number of controller outputs 107-1, 107-P. Example controller outputs can include firing rate, among other outputs, as further discussed herein.

The controller outputs 107-1, 107-P, as illustrated by FIG. 1, can be used to adjust operation of the combustion equipment 110 using a number of actuators 109-1, 109-Q. An actuator, as used herein, can include a motor responsible for moving or controlling a mechanism or system.

The controller outputs 107-1, 107-P can be determined by the controller 187 using the inputs from the number of sensors 106-1 . . . 106-N (e.g., sensor measurements) and a number of controller inputs 111. The number of controller inputs 111 can include setpoints, overrides, and/or controller settings, among other inputs.

In various embodiments, the offline database 102 can be used for storing the various types of data from the controller 187. For example, the sensor measurements, controller outputs 107-1, 107-P, and/or controller inputs 111 can be stored on the offline database 102. The computing component (e.g., computing component 104 or internal computing component 105) can run against the offline database 102, can be a part of the controller 187, and/or other combustion equipment (e.g., a boiler display).

Further, in some embodiments, the internal computing component 105 can include an appliance display. For instance, the appliance display can act as a user interface of the controller 187 and/or other combustion equipment. A user can adjust settings and readout status, diagnostics, etc. The display can illustrate text, numbers, graphs, etc. For instance, showing the evolution of some parameters over time can be useful for monitoring degradation and/or faults.

The offline database 102 can include a database that is remotely located from the combustion equipment 110 and the number of sensors 106-1 . . . 106-N. The offline database 102 can contain offline data. For example, the offline data can include data from a manufacturer and/or data (e.g., online data) measured from the combustion equipment during a previous period of time. Further, in some embodiments, the offline data can include a theoretical efficiency surface of particular combustion equipment, as discussed further herein.

Figure 2:
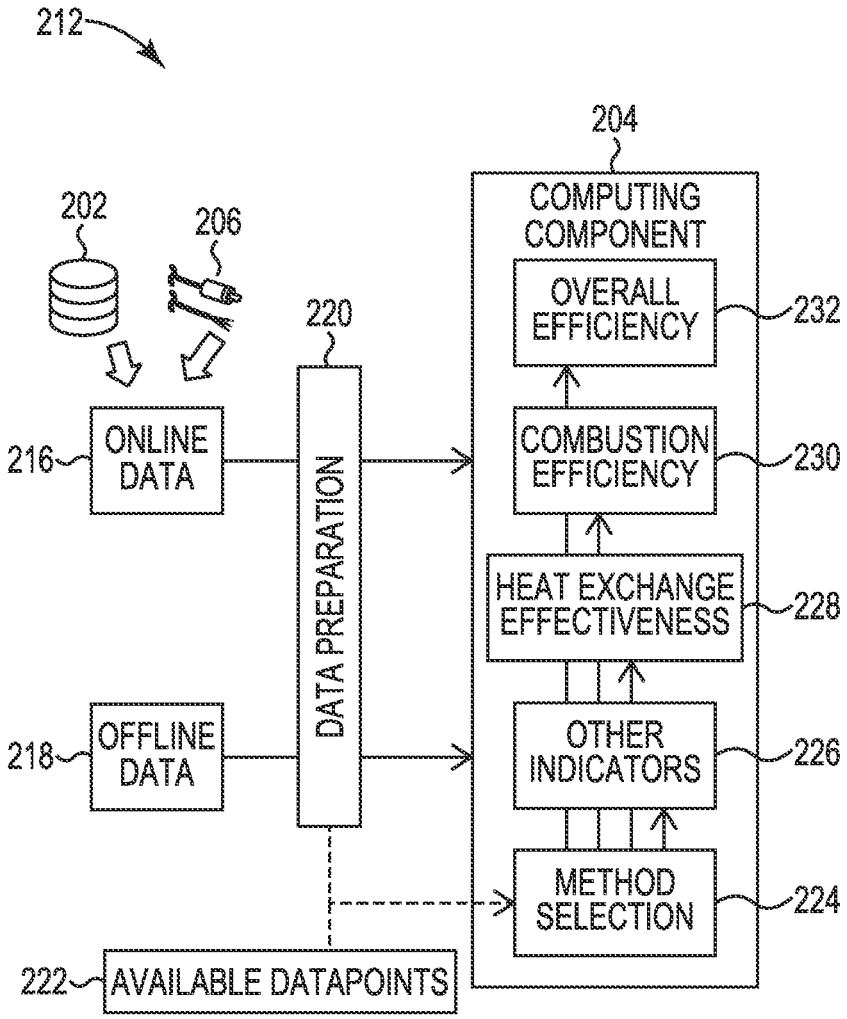
FIG. 2 illustrates an example of a process for monitoring efficiency of combustion equipment in accordance with one or more embodiments of the present disclosure.

FIG. 2 illustrates an example of a process 212 for monitoring efficiency of combustion equipment in accordance with one or more embodiments of the present disclosure. As illustrated by FIG. 2, the process 212 can include a computing component 204 determining an overall efficiency 232 of the combustion equipment and/or identifying other indicators 226, as discussed further in connection with FIGS. 7-8.

The process 212 can include using online data 216 and offline data 218. As previously discussed, the online data 216 can include measurements from a number of sensors 206 connected to the combustion equipment and/or actual values of internal parameters not directly associated with a sensor output. For example, the online data can include status information (e.g., whether equipment is in a run or idle mode), temperature setpoint, percentage of modulating values, speed of a fan, etc. The online data 216 can be directly from the number of sensors 206 and/or retrieved from an offline database 202. The offline data 218 can include manufacturer data and/or previously measured online data.

The online data 216 and offline data 218 can be processed by a data preparation module 220 to determine available data points 222. The data points 222 can include a number of measured values at particular periods of time.

One or more computing components (e.g., the computing component 204) can be used to monitor efficiency of the combustion equipment. For example, the process 212 can include a method selection 224, identifying other indicators 226, heat exchange effectiveness 228, combustion efficiency 230, and overall efficiency 232. The overall efficiency 232 can include normalizing an unscaled efficiency signal, as discussed further in connection with FIG. 3.

Although not illustrated by FIG. 2, the process 212 can include a key performance indicator (KPI) tracking. For instance, the KPI can include the overall efficiency 232 determined. The KPI can be tracked over time to detect faults and/or degradations and report them to a user.

FIG. 3 illustrates an example of a process 340 for monitoring efficiency of combustion equipment in accordance with one or more embodiments of the present disclosure. The process 340 can be performed using a computing component, such as the computing component 104 illustrated by FIG. 1 and/or the computing component 204 illustrated by FIG. 2.

The process 340 can include inputting online data 316 measured using a number of sensors. The online data 316 can be received by the computing component from the number of sensors connected to the combustion equipment and/or can be retrieved from an offline database. As previously discussed, the online data can include sensor measurements (e.g., sensor outputs) and/or actual values of internal parameters not directly associated with a sensor measurement (e.g., controller outputs). The online data can be prepared, at block 320-1, for further processing, as previously discussed.

As illustrated by the embodiment of FIG. 3, the online data 316 can include temperature of supply liquid, temperature of return liquid, fuel consumption, and/or firing rate of the combustion equipment. The liquid can include water, for example.

In some embodiments, the fuel consumption may not be directly measured using the number of sensors. For instance, the fuel consumption can be determined using other measured online data. Alternatively, the fuel consumption can be measured using a fuel consumption sensor (e.g., a flow sensor).

At block 342, an unscaled efficiency signal 341 can be determined using the online data 316 measured from the combustion equipment. An unscaled efficiency signal, as used herein, can include an estimated efficiency of the combustion equipment over a period of time. As illustrated by FIG. 3, the online data 316 used to determine the unscaled efficiency can include temperature of supply liquid, temperature of return liquid, fuel consumption, and/or firing rate of the combustion equipment.

In some embodiments, although not illustrated by FIG. 3, a model used to calculate an efficiency of the combustion equipment can be identified based on the measured online data 316. For example, the model can include a direct method used to calculate the unscaled efficiency signal 341. In such embodiments, determining the unscaled efficiency signal, at block 342, can include using model parameters of the identified model. The model parameters can include the measured online data 316, among other parameters.

The direct method can be used to determine the unscaled efficiency signal 341 which resembles the efficiency, in some embodiments. An unscaled efficiency signal 341 is generally not in physical units and can be in technical units. For instance, technical units can include a value that can be used for relative assessment (but not absolute assessment) and can reflect the actual efficiency of the combustion equipment.

To determine the unscaled efficiency signal 341, four data points are used: temperature of supply liquid, temperature of return liquid, fuel consumption, and fuel mass flow. An example direct method function can include:

$$n_{comp} = a * m_w * \frac{\Delta T}{m_{fuel}}.$$

Wherein $n_{comp}$ includes the determined unscaled efficiency signal 341, $m_w$ includes liquid mass flow, $m_{fuel}$ includes fuel consumption, and a can include a ratio of the specific heat constant of a liquid (e.g., water) and the high heating value (HHV) of a fuel (e.g., natural gas). However, the actual change of HHV is practically unknown and therefore HHV is approximated by a constant (e.g., given by a utility company). ΔT can include the change in liquid temperature before and after the combustion equipment (e.g., supply liquid temperature minus return liquid temperature). The signal 341 can be determined by calculating a value for unscaled efficiency of the combustion equipment over time (e.g., a data point for each time a measurement is made).

However, liquid mass flow $m_w$ may not be measured as it can be difficult to identify. Rather $m_w$ can be considered as a mean value and the term ($a*m_w$) can become a constant under the following assumptions: $m_w$ is dependent on a speed of the combustion equipment (e.g., a pump), and system response which consist of properties of a liquid distribution system (e.g., hydraulic resistance).

If liquid mass flow $m_w$ changes (e.g., is not constant) unexpectedly, then ΔT may also change. This can result in an unexpected change in determined efficiency, which can be detected. In response to the change, a user may be advised to check the combustion equipment.

In some embodiments, $m_{fuel}$ can be estimated using the firing rate of the combustion equipment. For example, estimating fuel consumption using the firing rate of the combustion equipment is described by the concurrently filed application of Petr Endel, Donald Kasprzyk, David Kucera, and Gregory Young, titled "Valve Controller Configured to Estimate Fuel Consumption", U.S. application Ser. No. 14/521,154, filed on Oct. 22, 2014, which is a continuation-in-part of U.S. application Ser. No. 13/326,691, titled "Gas Valve with Fuel Rate Monitor", filed on Dec. 15, 2011 the full disclosure of which are both incorporated herein by reference. Alternatively, $m_{fuel}$ can be measured using a fuel consumption sensor.

As further illustrated by FIG. 3, the process 340 can include inputting offline data 318. As previously discussed, the offline data 318 can include manufacturer data and/or online data from a previous period of time. The manufacturer data can include a datasheet for the combustion equipment and/or commissioning data.

The offline data 318 can identify controller settings, commissioning data, datasheet parameters, etc. For example, the offline data 318 can include a table of efficiency of the combustion equipment at a variety of firing rates and temperatures of return liquid from the manufacturer. The offline data 318 can be prepared, at block 320-2, for further processing, as previous discussed.

For example, using the offline data 318, a theoretical efficiency surface 346 of the combustion equipment can be identified. The identification can include determining the theoretical efficiency surface 346 and/or retrieving the theoretical efficiency surface 346 from an offline database.

A theoretical efficiency surface 346, as used herein, can include a digital representation of theoretical efficiency of combustion equipment at various operating conditions (e.g., firing rate and return liquid temperature). For example, the theoretical efficiency surface 346 can include a grid reflecting the efficiency of the undegraded (e.g., ideal) combustion equipment at time of commissioning. In some embodiments, the theoretical efficiency surface 346 can include a three-dimensional grid of return liquid temperature on the X-axis, firing rate on the Z-axis, and efficiency on the Y-axis.

In some embodiments, the theoretical efficiency surface 346 can be determined using the offline data 318. The theoretical efficiency surface 346 can be determined using the manufacturer's datasheet identifying return liquid temperature at a variety of firing rates of the undegraded combustion equipment and/or previously measured data (e.g., online data) that is measured when the combustion equipment is installed (e.g., and likely undegraded).

Alternatively and/or in addition, the theoretical efficiency surface 346 of a particular piece of combustion equipment can be retrieved from an offline database. For example, the theoretical efficiency surface 346 can be determined prior to the monitoring process 340 (e.g., at a different time) and stored on the offline database. Alternatively, the theoretical efficiency surface 346 can be determined from another sources and stored on the offline database.

In some embodiments, the identified theoretical efficiency surface 346 can be extrapolated to cover a wider range of operating conditions than the theoretical efficiency surface 346 covers. Extrapolating the theoretical efficiency surface 346 can include approximating the efficiency at a wider range of firing rates and return liquid temperatures than in the theoretical efficiency surface 346. The extrapolated theoretical efficiency surface can be used to determine the theoretical efficiency signal, as discussed further herein.

Alternatively and/or in addition, the identified theoretical efficiency surface 346 can be extrapolated and interpolated between the grid vertices to determine the theoretical efficiency for any combination of return liquid temperature and firing rate values. For example, the extrapolated and interpolated theoretical efficiency surface can be used to determine the theoretical efficiency signal.

At block 344, a theoretical efficiency signal 343 can be determined using the theoretical efficiency surface 346 and a subset of the measured online data 316. The theoretical efficiency signal 343 can include a theoretical estimate of the efficiency over a period of time. The theoretical efficiency signal 343 can include a signal in physical units that can be used for relative and absolute assessment of the combustion equipment.

As illustrated by FIG. 3, the subset of the online data 316 used to determine the theoretical efficiency signal 343 can include the temperature of return liquid and firing rate of the combustion equipment. The firing rate can be output by the controller of the combustion equipment, for example.

At block 348, the unscaled efficiency signal 341 can be compared to the theoretical efficiency signal 343 to identify a common pattern. The common pattern can include a correlation (e.g., a threshold correlation) between a time series (e.g., a portion) of the theoretical efficiency signal 342 and a time series of the unscaled efficiency signal 341.

Common patterns can be identified using a variety of similarity measures. For example, a common pattern can be identified in response to a similarity measure meeting or exceeding a predefined threshold value (e.g., 0.85). Example similarity measures can include Pearson's correlation, mean similarity, root mean square similarity, peak similarity, cosine similarity, Kendall's correlation, and/or Spearman's correlation, among other measures.

For example, if the similarity measure meets or exceeds the threshold value, the output can be 1 (meaning "correlated"). If the similarity measure does not meet or exceed the threshold value the output can be 0 (meaning "uncorrelated"). In response to an output of 1, a similarity 345 can be identified.

At block 350, the unscaled efficiency signal 341 can be normalized using values from a correlated portion of the theoretical efficiency signal 343 to monitor efficiency of the combustion equipment. The correlated portion can be within the identified common pattern, for example. That is, the correlated portion of the theoretical efficiency signal 343 can include a common pattern with a portion of the unscaled efficiency signal 341.

The normalization can output (e.g., create) a normalized efficiency signal $n_{Norm}$ 352 that is in physical units and/or reflects a true efficiency of the combustion equipment. For example, as illustrated further in connection with FIG. 5, the normalization of the unscaled efficiency signal 341 can include an adjustment of coefficients for a range of the unscaled efficiency signal 341 to a range of the theoretical efficiency signal 343 and a bias of the unscaled efficiency signal 341 to a bias of the theoretical efficiency signal 343.

In some embodiments, the process 340 can include outputting an error message in response to not identifying a common pattern. For instance, a computing component can output the error message and/or not perform the normalization in response to not identifying the common pattern.

Figure 4:
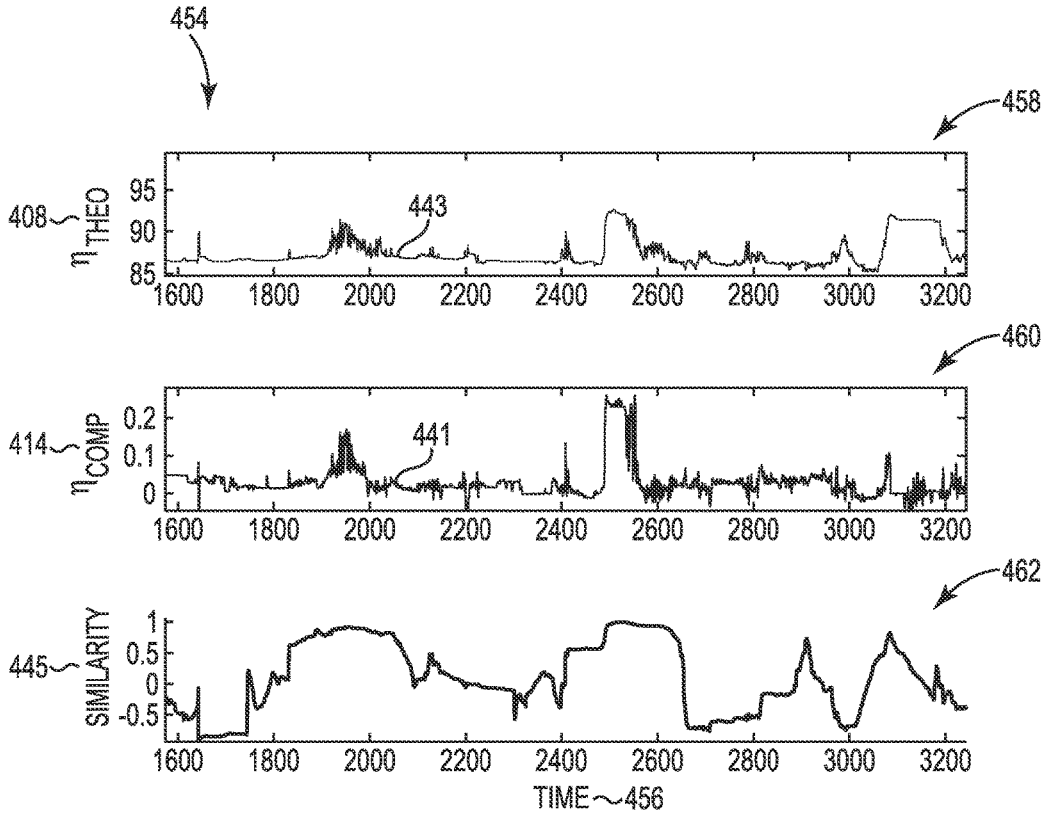
FIG. 4 illustrates an example of a comparison of an unscaled efficiency signal and a theoretical efficiency signal in accordance with one or more embodiments of the present disclosure.

FIG. 4 illustrates an example of a comparison 454 of an unscaled efficiency signal 441 and a theoretical efficiency signal 443 in accordance with one or more embodiments of the present disclosure.

As illustrated by the embodiment of FIG. 4, the theoretical efficiency signal 443 can be illustrated by a graph 458 with time 456 on the X-axis and determined theoretical efficiency values 408 on the Y-axis. The unscaled efficiency signal 441 can be illustrated by a graph 460 with time 456 on the X-axis and determined unscaled efficiency values 414 on the Y-axis. As illustrated by FIG. 4, the theoretical efficiency signal 443 can include physical units and the unscaled efficiency signal 441 can include technical units.

The signals 441, 443 can be compared using similarity measures to identify correlated portions. The comparison can be illustrated by a graph 462 with time 456 on the X-axis and similarity measures 445 on the Y-axis. Portions of the graph 462 that have a similarity measure 445 that is greater than a threshold value (e.g., 0.85) can include a common pattern/correlated.

Figure 5:
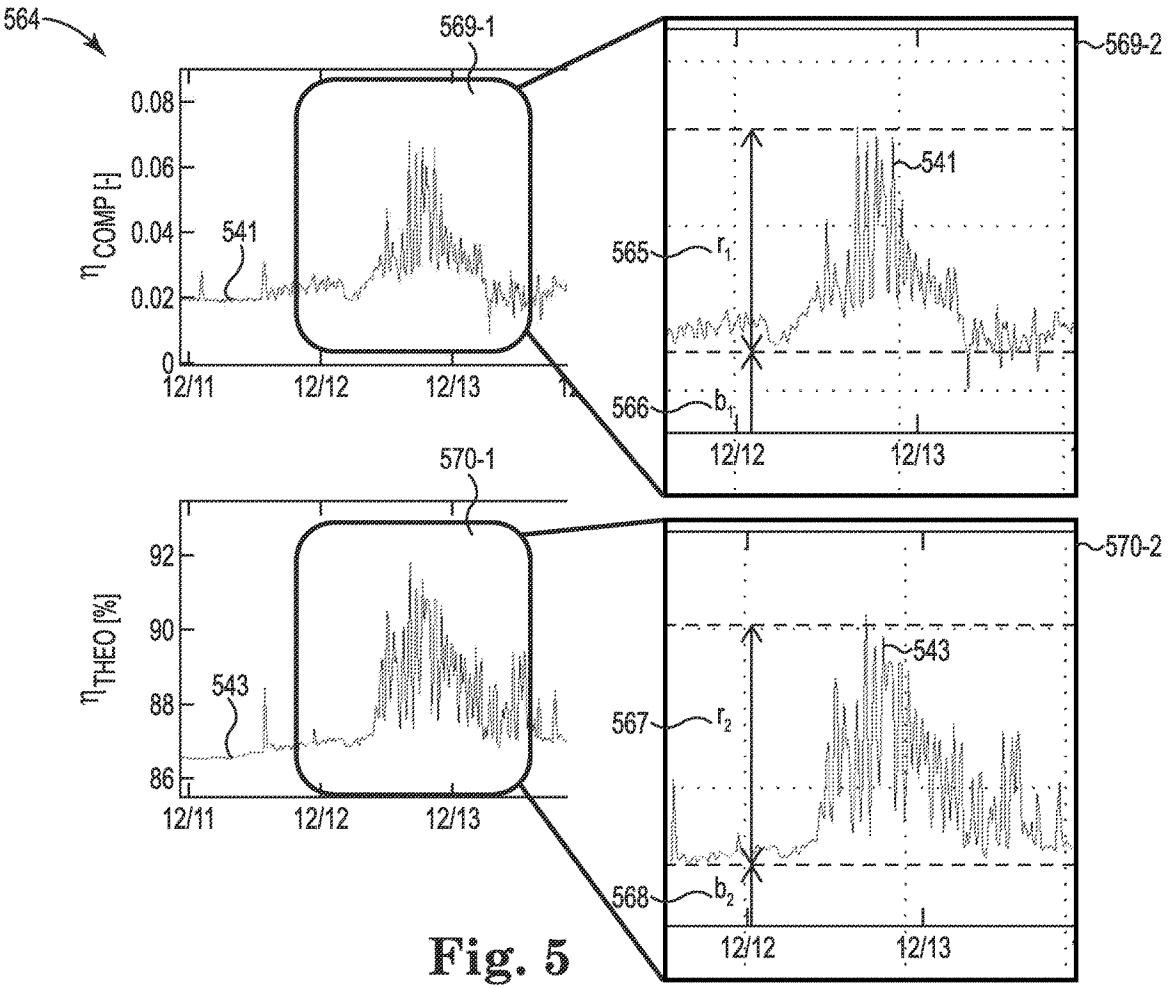
FIG. 5 illustrates an example of a process for normalizing an unscaled efficiency signal in accordance with one or more embodiments of the present disclosure.

FIG. 5 illustrates an example of a process 564 for normalizing an unscaled efficiency signal 541 in accordance with one or more embodiments of the present disclosure.

As illustrated by FIG. 5, a portion 569-1 of the unscaled efficiency signal 541 and a portion 570-1 of the theoretical efficiency signal 543 can be correlated. The portions 569-1, 570-1 can be identified as a common pattern.

For illustrative purposes, FIG. 5 illustrates the portion 569-1, 570-1 of the signals 541, 543 in a closer view 569-2, 570-2. The closer view 569-2, 570-2 can include the same portions 569-1, 570-1.

As previously discussed, the normalization can include an adjustment of coefficients for a range 565 of the unscaled efficiency signal 541 to a range 567 of the theoretical efficiency signal 543. In addition, the normalization can include an adjustment of coefficients for a bias 566 of the unscaled efficiency signal 541 to a bias 568 of the theoretical efficiency signal 543. The normalization can include an output, for instance, of a normalized efficiency signal that is in physical units.

Embodiments in accordance with the present disclosure are not limited to constructing a graph as illustrated by FIGS. 4-5 and do not require that a physical or graphical representation of the information actually exist. Rather, such a graph 458, 460, 462, 541, 543 can be represented as a data structure in a tangible medium.

Figure 6:
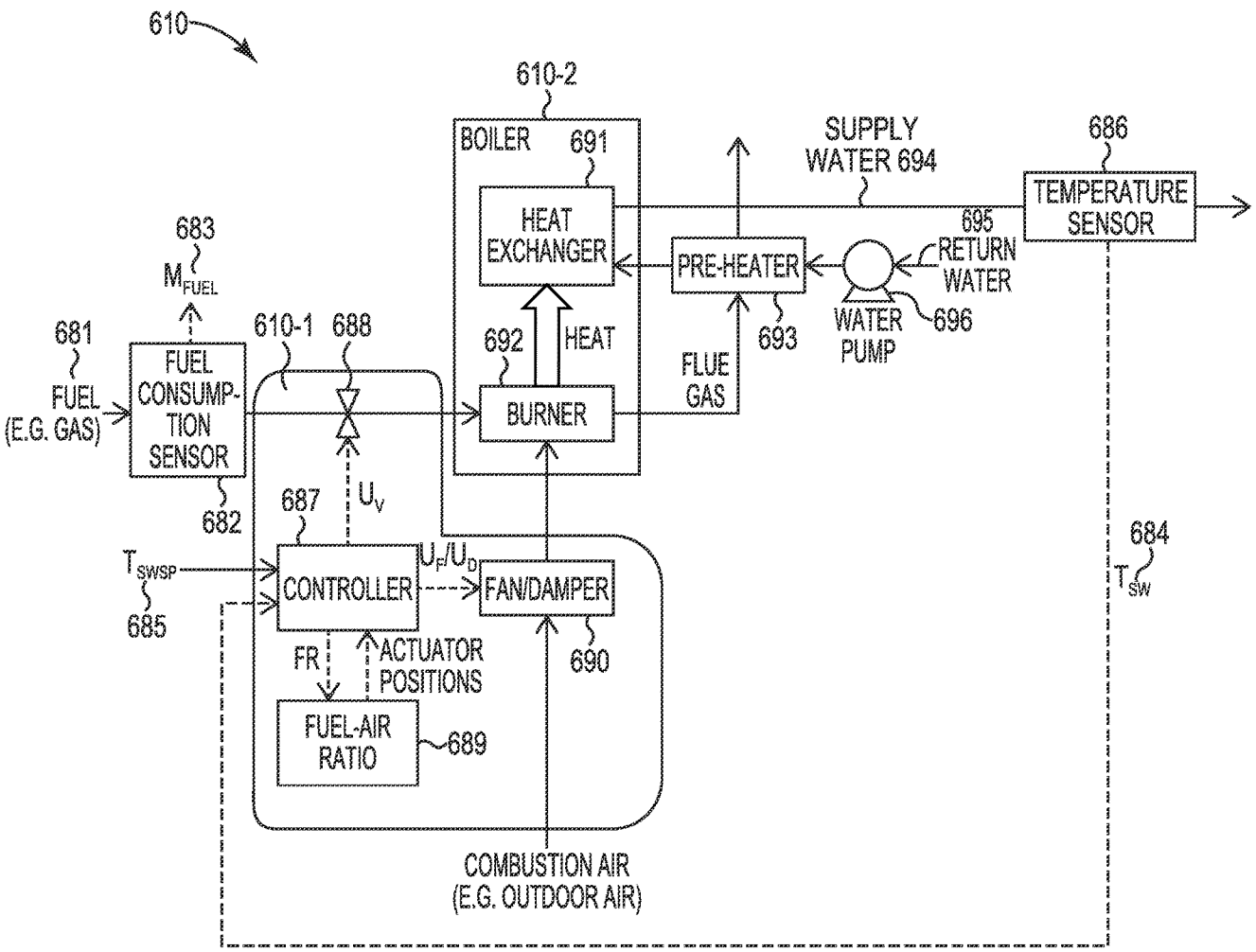
FIG. 6 illustrates an example of combustion equipment in accordance with one or more embodiments of the present disclosure.

FIG. 6 illustrates an example of combustion equipment 610 in accordance with one or more embodiments of the present disclosure. The combustion equipment 610 can be monitored for an overall efficiency and/or for a performance indicator, as discussed herein.

As illustrated by FIG. 6, the combustion equipment 610 can include a boiler 610-2 (e.g., a hydronic boiler), a fan-valve-controller subsystem 610-1, and/or a number of other components and/or subsystems. For instance, the boiler 610-2 can include a heat exchanger 691 and a burner 692. The burner 692 can output heat to a heat exchanger 691 and flue gas to an external pre-heater 693. Supply water 694 (e.g., at a particular temperature $T_{SW}$ 684) can be output from the boiler 691 and the water can return 695 (e.g., at a particular temperature $T_{RW}$) through a water pump 696 to the pre-heater 693 and back to the heat exchanger 691 of the boiler 610-2.

The fan-valve-controller subsystem 610-1 can include a controller 687, a valve 688, and a fan 690 (and, in some embodiments, a damper). The controller 687 can control the position of the valve 688, speed of the fan 690, and/or position of the damper. Based on the various controlled positions and/or speeds, fuel 681 can be input to the burner 692 of the boiler 610-2. The rate of fuel input can be controlled by the value position, damper position, and/or speed of the fan 690.

The fan 690 can include variable-frequency drive (VFD) fan or a constant-frequency drive (CFD) fan, among other fans. For instance, a CFD fan can include a damper. Combustion air (e.g., outdoor air) can be input to the VFD fan and sent to the boiler 610-2 or input to the CFD fan, sent to the damper, and then sent to the boiler 610-2.

As illustrated by FIG. 6, the input fuel 681 can be measured by a fuel consumption sensor 682 to determine total fuel consumption 683 (e.g., $m_{fuel}$). Further, a temperature sensor 686 can measure the supply water temperature 694 (e.g., $T_{SW}$). The temperature sensor 686 can send the measured supply water temperature 684 to the controller 687.

The controller 687 can determine a difference in the supply water temperature Tsw 684 and a supply water temperature setpoint Tswsp 685 (e.g., ΔT). The supply water temperature setpoint 685 (e.g., $T_{SWSP}$) can be a constant number set-up during commissioning or it can be a variable number determined by the controller 687, e.g., based on outdoor temperature, schedule, etc.

For example, the difference between both temperatures (i.e. temperature deviation from setpoint) is determined (e.g., calculated) by the controller 687. Based on the difference, the controller 687 can perform a control action (e.g., increase/decrease of fan speed or open/close a damper).

In accordance with some embodiments, the controller 687 can determine a valve position $U_V$, a fan speed $U_F$, and/or a damper position $U_D$ using measured data (e.g., online data) and fuel-air-ratio tables 689 based on the firing rate of the combustion equipment. For example, the fuel-air-ratio tables 689 can be stored on the controller 687.

The controller 687 and/or an external computing component can monitor the fan-valve-controller subsystem 610-1 to identify a parameter and/or a fuel consumption model using data measured (e.g., online data) and provide a performance indicator based on a comparison of the parameter/the fuel consumption model to a baseline parameters/baseline fuel consumption model of the combustion equipment, as discussed in connection with FIG. 7.

Figure 7:
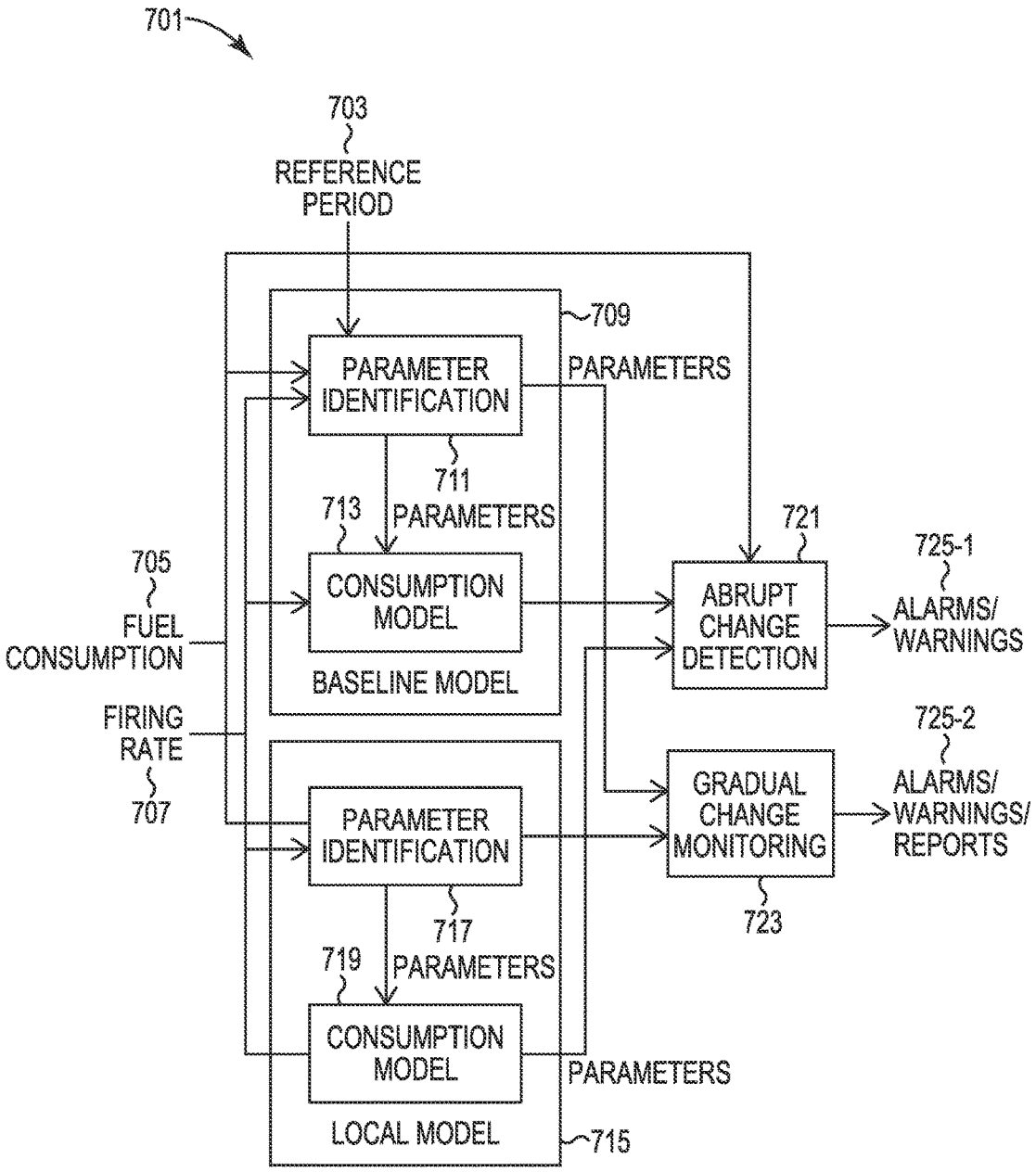
FIG. 7 illustrates an example of a process for monitoring efficiency of combustion equipment in accordance with one or more embodiments of the present disclosure.

FIG. 7 illustrates an example of a process 701 for monitoring operational mode changes of combustion equipment in accordance with one or more embodiments of the present disclosure. The process 701 can be performed using the controller 687 illustrated in FIG. 6 and/or a remote computing component remote.

For instance, the process 701 can be used to provide a performance indicator. A performance indicator, as used herein, can include an indication of an operational mode change in the combustion equipment. An operational mode change can include an (e.g., unexpected or unnecessary) increase in fuel consumption and can occur as a result of control strategy changes, faults, and/or changes to input variables, as discussed further herein.

For example, control strategy changes can include fuel-air-ratio modifications. A maintenance technician, for instance, may change the valve position as a function of load (e.g., firing rate) resulting in higher fuel consumption at the same firing rate.

Example faults can include a faulty valve, a damaged fan, and/or a faulty damper. A faulty valve can result in issues in opening or closing the valve, a leaking valve, etc. A damaged fan can be due to a bearing fault or degraded fan efficiency. And, a faulty damper (in embodiments of CFD fans) can include issues in moving the damper (e.g., a stuck damper).

Changes of input variables can include a change in fuel pressure, fuel temperature, and/or fuel (e.g., in the case of dual-fuel systems). Changes in input variables can result in a change in fuel consumption.

The performance indicator can be provided in response to a change in an identified parameter from measured data (e.g., online data) as compared to a baseline parameter. Alternatively and/or in addition, the performance indicator can be provided in response to an expected fuel consumption determined using an updated fuel consumption model and/or a baseline fuel consumption model including a threshold change from measured fuel consumption. The performance indicator can include an absolute value or a normalized value.

For example, the process 701 can include identifying a parameter from data measured, at block 717. The data measured, as previously discussed, can be online data measured using a number of sensors connected to the combustion equipment.

The parameter can include an indication of performance of the combustion equipment. For example, the parameter can include a slope of a fuel consumption model. A fuel consumption model, as used herein, can include a relationship between the firing rate and the fuel consumption of the combustion equipment.

As previously discussed, the firing rate can be output from the controller. For example, the firing rate can include how much heat to add to the supply liquid.

The data can include measured fuel consumption 705 and firing rate 707 of the combustion equipment. The number of sensors can include temperature sensors, a fuel consumption sensor (to measure the fuel consumption 705), and/or a controller (to output a firing rate).

The measured data can be used to update a fuel consumption model, at block 719. For instance, the fuel consumption model can include a model of fuel consumption that is updated using current data measured from the combustion equipment.

In some embodiments, as illustrated by FIG. 7, the fuel consumption model can include a local fuel consumption model 715. A local fuel consumption model 715 can include a model of fuel consumption that is updated iteratively (e.g., continuously) using current measured data (e.g., current online data).

To monitor efficiency of the combustion equipment, the parameter identified can be compared to a baseline parameter of a baseline fuel consumption model. Alternatively and/or in addition, an output of the updated fuel consumption model and/or a baseline fuel consumption model (e.g., fuel consumption expected using each respective model) can be compared to a measured fuel consumption of the combustion equipment.

A baseline fuel consumption model can include a model of fuel consumption that is determined during a reference period 703. A reference period, as used herein, can include a period of time when the combustion equipment is known to be and/or likely to be operating efficiently (e.g., undegraded/not faulty). For example, a reference period can include when the combustion equipment is installed or commissioned.

The baseline parameter can include an indication of performance of the combustion equipment during the reference period 703. The baseline fuel consumption model can be stored (e.g., on the controller and/or a remote computing component) and not updated.

In some embodiments, the baseline fuel consumption model 709 can be determined, at block 713, using data measured (e.g., online data measured using the number of sensors) during the reference period of time 703. For instance, the baseline fuel consumption model 709 and the fuel consumption model (e.g., the local fuel consumption model 715) can be determined using a consumption model. An example consumption model can include a linear polynomial model such as:

$$m_{Fuel}=a_1*FR+b,$$

wherein $m_{Fuel}$ can include fuel consumed for a particular equipment (e.g., a boiler), $a_1$ includes a slope, and FR includes a firing rate for the particular equipment. Another example can include:

$$M_{Fuel}=a_1*FR+\ldots a_N*FR^N,$$

wherein N includes a model order.

Further, the baseline parameter can be identified, at block 711. For instance, the baseline parameter can include a slope of the baseline fuel consumption model 709 and the identified parameter can include a slope of the updated fuel consumption model (e.g., the updated local fuel consumption model 715). The parameters can be identified using a recursive identification method (e.g., a Kalman filter and/or a particle filter) on the respective models.

A performance indicator of the combustion equipment can be provided in response to an abrupt change and/or a gradual change. For example, at block 721, an abrupt change can be identified (e.g., via a performance indicator) in response to an output of the updated fuel consumption model (e.g., local fuel consumption model 715) and/or the baseline fuel consumption model 709 meeting or exceeding a threshold change from measured fuel consumption. The threshold change can include a threshold difference in an output (e.g., expected fuel consumption) of the fuel consumption model and/or the baseline fuel consumption model 709 as compared to measured fuel consumption (e.g., actual fuel consumption) of the combustion equipment.

At block 723, a gradual change can be monitored/identified (e.g., via a performance indicator) in response to the identified parameter meeting or exceeding a threshold change from the baseline parameter. The threshold change can, for example, include a threshold change in the slope of the updated fuel consumption model (e.g., local fuel consumption model 715) as compared to slope of the baseline fuel consumption model 709.

At block 725-1 and/or 725-2, in response to an identified abrupt change and/or gradual change, the performance indicator can be provided. The provided performance indicator can include an alert, such as an alarm and/or a warning. Providing an alert, as used herein, can include providing a message on a user interface of a computing component, sending an email to a user, providing a visual or audio indication (e.g., a beeping sound, flashing message stating "alarm", etc.), and/or sending a text message to a cellphone of a user, among other alarms/warnings. In some embodiments, the alert can include generating a report.

Figure 8:
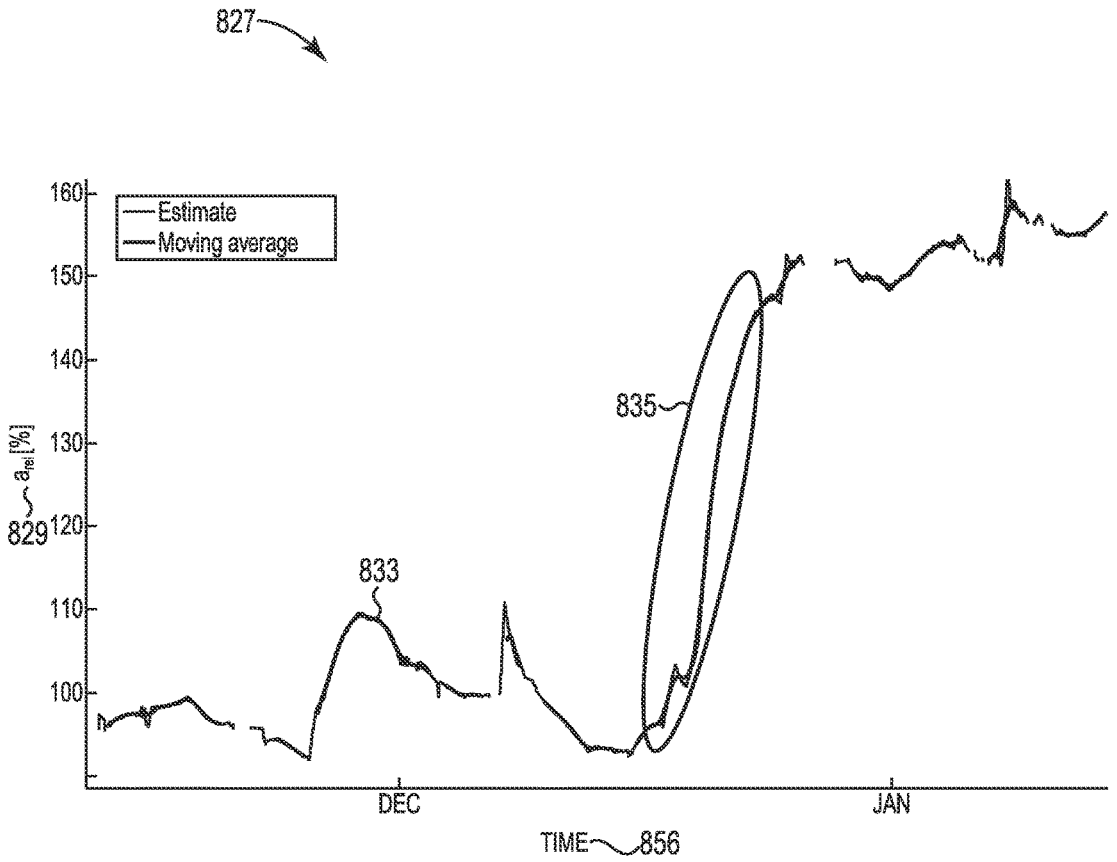
FIG. 8 illustrates an example of a graph for monitoring efficiency of combustion equipment in accordance with one or more embodiments of the present disclosure.

FIG. 8 illustrates an example of a graph 827 for monitoring operational mode changes of combustion equipment in accordance with one or more embodiments of the present disclosure. The graph 827 illustrated by FIG. 8 can include a relative (percentual) change in an identified parameter (e.g., parameter a). A performance indicator can be provided in response to comparing the identified parameter of an updated fuel consumption model to a baseline parameter of the baseline fuel consumption model.

However, as previously discussed, embodiments are not limited to comparing parameters. For example, embodiments can include comparing each model (e.g., the expected output of the updated fuel consumption and the baseline fuel consumption model) to a measured fuel consumption.

As illustrated by FIG. 8, the graph 827 can include time 856 on the X-axis and slope values 829 on the Y-axis. The slope values 829 can be plotted over time to form a line 833. The line 833 can indicate a relationship of fuel consumption to firing rate over time.

A portion 835 of the line 833 plotted can represent an identified performance indicator. For instance, the portion 835 of the line 833 can illustrate an increase in fuel consumption as compared to prior times. The increase in fuel consumption can indicate an operational mode change (e.g., a performance indicator). Said differently, the portion 835 of the line 833 can illustrate an increase of the identified parameter a caused by an operation mode change, which can result in an unexpected increase of fuel consumption.

In some embodiments, as illustrated previously by FIG. 2, the performance indicator can be used in addition to determining an efficiency (e.g., degradation) of the combustion equipment to provide more information to a user. For example, a user may be informed of a performance indicator and a decrease in determined efficiency. The combined information can inform the user to check the combustion equipment for faults and/or degradation. The determined decrease can be as compared to an efficiency at another (e.g., previous) period of time.

Although FIG. 8 illustrates a physical or graphical graph of the comparison, a physical or graphical graph may not exist in accordance with embodiments of the present disclosure. That is, the comparison and identification of the performance indicator can be represented as a data structure in a tangible medium. Alternatively and/or in addition, the graph 827 can be provided as a report to a user.

As used herein, "logic" is an alternative or additional processing resource to execute the actions and/or functions, etc., described herein, which includes hardware (e.g., various forms of transistor logic, application specific integrated circuits (ASICs), etc.), as opposed to computer executable instructions (e.g., software, firmware, etc.) stored in memory and executable by a processor.

Although specific embodiments have been illustrated and described herein, those of ordinary skill in the art will appreciate that any arrangement calculated to achieve the same techniques can be substituted for the specific embodiments shown. This disclosure is intended to cover any and all adaptations or variations of some embodiments of the disclosure.

It is to be understood that the above description has been made in an illustrative fashion, and not a restrictive one. Combination of the above embodiments, and other embodiments not specifically described herein will be apparent to those of skill in the art upon reviewing the above description.

The scope of some embodiments of the disclosure includes any other applications in which the above structures and methods are used. Therefore, the scope of some embodiments of the disclosure should be determined with reference to the appended claims, along with the full range of equivalents to which such claims are entitled.

In the foregoing Detailed Description, various features are grouped together in example embodiments illustrated in the figures for the purpose of streamlining the disclosure. This method of disclosure is not to be interpreted as reflecting an intention that the embodiments of the disclosure require more features than are expressly recited in each claim.

Rather, as the following claims reflect, inventive subject matter lies in less than all features of a single disclosed embodiment. Thus, the following claims are hereby incorporated into the Detailed Description, with each claim standing on its own as a separate embodiment.

What is claimed:

1. A method for monitoring efficiency of combustion equipment including:

determining an unscaled efficiency signal of combustion equipment using data measured from the combustion equipment;

determining a theoretical efficiency signal of the combustion equipment using a theoretical efficiency surface of the combustion equipment and a subset of the measured data;

normalizing the unscaled efficiency signal using values from a correlated portion of the theoretical efficiency signal to monitor efficiency of the combustion equipment;

providing, to a user, an alert from a controller in response to at least one of:

an identified parameter of a fuel consumption model determined using the measured data meeting or exceeding a threshold change from a baseline parameter; and an output of the fuel consumption model meeting or exceeding a threshold change from a measured fuel consumption; and altering, by the controller, an operating condition of the combustion equipment responsive to input from the user after the alert has been provided to the user, wherein altering the operating condition of the combustion equipment includes changing a position of a valve, speed of a fan, position of a damper, or a combination thereof of a fan-valve-controller subsystem of the combustion equipment.

2. The method of claim 1, including receiving the measured data from a number of sensors connected to the combustion equipment, wherein the measured data includes a temperature of supply liquid and a temperature of return liquid.

3. The method of claim 1, wherein the subset of the measured data includes a temperature of return liquid and a firing rate of the combustion equipment.

4. The method of claim 1, including determining a fuel consumption of the combustion equipment using the measured data and wherein the determined fuel consumption is used to determine the unscaled efficiency signal.

5. The method of claim 1, including determining the theoretical efficiency surface using offline data, wherein the offline data includes at least one of:

manufacturer data for the combustion equipment; and data measured from the combustion equipment during a previous period of time.

6. The method of claim 1, wherein normalizing the unscaled efficiency signal includes:

adjusting coefficients for a range of the unscaled efficiency signal to a range of the theoretical efficiency signal and a bias of the unscaled efficiency signal to a bias of the theoretical efficiency signal.

7. A non-transitory computer-readable medium, comprising instructions executable by a processing resource to cause a computing device to:

identify a parameter from data measured using a number of sensors connected to combustion equipment;

update a fuel consumption model using the measured data;

compare the identified parameter to a baseline parameter of a baseline fuel consumption model;

compare the updated fuel consumption model and the baseline fuel consumption model to a measured fuel consumption of the combustion equipment; and provide, to a user, a performance indicator of the combustion equipment from a controller in response to at least one of:

the identified parameter meeting or exceeding a threshold change from the baseline parameter; and an output of the updated fuel consumption model or the baseline fuel consumption model meeting or exceeding a threshold change from the measured fuel consumption; and alter, by the controller, an operating condition of the combustion equipment responsive to input from the user after the performance indicator has been provided to the user, wherein altering the operating condition of the combustion equipment includes changing a position of a valve, speed of a fan, position of a damper, or a combination thereof of a fan-valve-controller subsystem of the combustion equipment.

8. The medium of claim 7, wherein the measured data includes a fuel consumption and a firing rate of the combustion equipment.

9. The medium of claim 7, wherein the instructions are executable by the processing resource to determine the baseline fuel consumption model using data measured during a reference period of time.

10. The medium of claim 7, wherein the identified parameter includes a slope of the updated fuel consumption model and the identified baseline parameter includes a slope of the baseline fuel consumption model.

11. The medium of claim 7, wherein the fuel consumption model includes a local fuel consumption model that is updated iteratively using current online data.

12. The medium of claim 7, wherein the instructions are executable by the processing resource to provide the performance indicator of the combustion equipment and a potential degradation of combustion equipment in response to a determined decrease in efficiency from a previous period of time.

13. The medium of claim 7, wherein the provided performance indicator of the combustion equipment includes an alert to a user.

14. An efficiency monitoring system including:

combustion equipment;

an offline database including offline data;

a number of sensors connected to the combustion equipment and configured to measure online data from the combustion equipment; and a computing component configured to:

determine an unscaled efficiency signal of the combustion equipment using the online data;

identify a theoretical efficiency surface of the combustion equipment using the offline data;

extrapolate and interpolate the identified theoretical efficiency surface to cover a wider range of operating conditions than the identified theoretical efficiency surface;

determine a theoretical efficiency signal of the combustion equipment using the extrapolated and interpolated theoretical efficiency surface and a subset of the online data;

compare the unscaled efficiency signal to the theoretical efficiency signal to identify a common pattern;

normalize the unscaled efficiency signal using values from a correlated portion of the theoretical efficiency signal within the identified common pattern; and alter, by the computing component, an operating condition of the combustion equipment responsive to input from a user after the normalized unscaled efficiency signal has been provided to the user, wherein altering the operating condition of the combustion equipment includes changing a position of a valve, speed of a fan, position of a damper, or a combination thereof of a fan-valve-controller subsystem of the combustion equipment.

15. The system of claim 14, wherein the computing component is configured to identify a model to use to calculate efficiency of the combustion equipment, wherein the model includes a direct method to determine the unscaled efficiency signal.

16. The system of claim 14, wherein:

the number of sensors are connected to a controller of the combustion equipment; and the computing component includes the controller.

17. The system of claim 14, wherein the common pattern includes a correlation between a time series of the theoretical efficiency signal and a time series of the unscaled efficiency signal.

18. The system of claim 14, wherein the normalized efficiency signal includes an output of a normalized efficiency signal in physical units.

* * * * *